US007427348B2

(12) United States Patent
Calemma et al.

(10) Patent No.: US 7,427,348 B2
(45) Date of Patent: Sep. 23, 2008

(54) PROCESS FOR THE PRODUCTION OF PARAFFINIC MIDDLE DISTILLATES

(75) Inventors: Vincenzo Calemma, San Donato Milanese (IT); Silvia Guanziroli, Monza (IT); Silvia Pavoni, Pioltello (IT); Roberto Giardino, Besate (IT)

(73) Assignees: ENI S.p.A., Rome (IT); Enitecnologie S.p.A., San Donato Milanese (IT); Institut Francais du Petrole, Rueil-Malmaison (FR)

( * ) Notice: Subject to any disclaimer, the term of this patent is extended or adjusted under 35 U.S.C. 154(b) by 606 days.

(21) Appl. No.: 10/481,878

(22) PCT Filed: Jun. 26, 2002

(86) PCT No.: PCT/EP02/07199

§ 371 (c)(1),
(2), (4) Date: May 27, 2004

(87) PCT Pub. No.: WO03/004585

PCT Pub. Date: Jan. 16, 2003

(65) Prior Publication Data

US 2004/0206667 A1 Oct. 21, 2004

(30) Foreign Application Priority Data

Jul. 6, 2001 (IT) ..... MI2001A1441

(51) Int. Cl.
*C10G 45/00* (2006.01)
*C10G 47/02* (2006.01)

(52) U.S. Cl. ..... 208/57; 208/89; 208/108; 208/950

(58) Field of Classification Search ..... 208/57, 208/89, 108, 950
See application file for complete search history.

(56) References Cited

U.S. PATENT DOCUMENTS

| | | | | |
|---|---|---|---|---|
| 4,071,574 | A | 1/1978 | Milstein et al. | |
| 4,080,397 | A | 3/1978 | Derr et al. | |
| 4,544,792 | A * | 10/1985 | Smith et al. | 585/533 |
| 5,378,348 | A * | 1/1995 | Davis et al. | 208/27 |
| 5,689,031 | A * | 11/1997 | Berlowitz et al. | 585/734 |
| 6,475,375 | B1 * | 11/2002 | Dancuart | 208/78 |
| 6,583,186 | B2 * | 6/2003 | Moore, Jr. | 518/700 |
| 6,589,415 | B2 * | 7/2003 | Smith et al. | 208/59 |
| 2004/0206667 | A1 | 10/2004 | Calemma et al. | |

OTHER PUBLICATIONS

U.S. Appl. No. 10/563,449, filed Jan. 3, 2006, Calemma et al.

* cited by examiner

*Primary Examiner*—Glenn Caldarola
*Assistant Examiner*—John C Douglas
(74) *Attorney, Agent, or Firm*—Oblon, Spivak, McClelland, Maier & Neustadt, P.C.

(57) ABSTRACT

A process with an increased efficiency for the preparation of middle distillates with excellent properties at low temperatures and substantially without oxygenated organic compounds, starting from a synthetic mixture of hydrocarbons at least partly waxy, containing a fraction of alcohols, comprising the separation of the mixture into a low-boiling fraction and a high-boiling fraction; the subsequent hydrogenation of the low-boiling fraction under such conditions as to avoid any substantial variation in its average molecular weight; the joining of at least a part of the hydrogenated fraction with said high-boiling fraction, and the subsequent catalytic hydrocracking treatment of the mixture of hydrocarbons thug formed, to obtain a substantial conversion of the waxy part into middle distillate.

40 Claims, 2 Drawing Sheets

PROCESS FOR THE PRODUCTION OF PARAFFINIC MIDDLE DISTILLATES

CROSS REFERENCES TO RELATED APPLICATIONS

This application is a 371 of International Patent Application No. PCT/EP02/07199, filed on Jun. 26, 2002, and claims priority to Italian Patent Application No. M101A001441, filed on Jul. 6, 2001.

The present invention relates to a process for the production of paraffinic middle distillates.

More specifically, the present invention relates to a process for the production of middle distillates comprising a hydrocracking reaction of a charge coming from a synthesis process of hydrocarbons, in particular a process based on a synthesis reaction of the Fischer-Tropsch type.

It is known that mixtures of prevalently linear hydrocarbons are obtained by means of direct synthesis from certain mixtures of hydrogen and carbon monoxide in so-called Fischer-Tropsch (hereafter abbreviated "F-T") processes, from the name of the inventors of the first synthesis of this type in the thirties'. Whereas the original F-T process prevalently used synthesis gas produced starting from carbon or bituminous residues, recently the use of methane or natural gas, having a more favourable H/C ratio, has become widely used.

It is also known that although these processes can be adapted to producing middle hydrocarbon cuts, the best performances, in terms of conversion level, selectivity of the catalyst and operating costs, are obtained when the degree of the advance of the synthesis is high, i.e. when hydrocarbon mixtures are produced comprising a significant fraction (>40-50% by weight) having a high boiling point, commonly referring to cuts with a temperature higher than 370° C. Another characteristic of the F-T synthesis is the impossibility of synthesizing products characterized by a narrow chain-length distribution. In the case of $C_5^+$ products obtained with catalysts based on cobalt of the last generation, the weight fraction of middle distillates ($C_{10}$-$C_{22}$) ranges from 0.3 to 0.6 whereas the remaining fraction consists of heavier products (0.6-0.4) and naphtha (0.05-0.2). Furthermore, due to the linear paraffinic structure of F-T products, the middle distillates thus obtained have scarce properties at low temperatures which prevents them from being commercialized as fuels as such. Owing therefore to the impossibility of producing middle distillates, by means of F-T synthesis, having high yields and good properties at low temperatures, F-T products are usually subjected to an upgrading step to improve the above aspects. To achieve this double objective, resort is made to subjecting F-T products to more or less complex hydrocracking processes. The term middle distillates refers to a mixture of hydrocarbons with a boiling point range corresponding to that of the "kerosene" or "gas oil" fractions obtained during the atmospheric distillation of petroleum. In said distillation, the boiling point range which defines the majority of "middle distillates", generally varies from 150 to 370° C. The middle distillate cut consists in turn of: 1) one or more kerosene fractions with a boiling point range generally between 150 and 260° C.; 2) one or more gas oil fractions with a boiling point range generally between 180 and 370° C.

It is known that high yields to middle distillates can be obtained by subjecting a high-boiling hydrocarbon mixture, normally having a distillation range higher than 350° C., to a high temperature degradative catalytic process, in the presence of hydrogen. These processes, more commonly defined as hydrocracking processes, are normally carried out in the presence of a bifunctional catalyst, containing a metal with a hydro-dehydrogenating activity supported on an inorganic solid comprising at least one oxide or silicate with acid characteristics.

Hydrocracking catalysts typically comprise metals of groups 6 to 10 of the periodic table of elements (in the form approved of by IUPAC and published by the "CRC Press Inc." in 1989, to which reference is made to hereunder), especially nickel, cobalt, molybdenum, tungsten or noble metals such as palladium or platinum. Whereas the former are more suitable for processing hydrocarbon mixtures with relatively high sulfur contents, noble metals are more active but are poisoned by the sulfur and require an essentially sulfur-free feeding.

Carriers which are normally used for the purpose are various types of zeolites (β, Y), X—$Al_2O_3$ (wherein X can be Cl or F), silico-aluminas, the latter amorphous or with various degrees of crystallinity or mixtures of crystalline zeolites and amorphous oxides. A very wide description of the different catalysts, the specific characteristics and various hydrocracking processes based thereon, is provided, among the many descriptions available in literature, in the publication of J. Scherzer and A. J. Gruia "Hydrocracking Science and Technology", Marcel Dekker, Inc. Editor (1996).

Although the availability of high-boiling mixtures or waxes, produced directly, for example, by means of synthesis processes of the Fischer-Tropsch type, is extremely desirable (absence of polycondensed aromatic compounds, asphaltenes, sulfur and organic nitrogen), a particular selection of catalysts and process conditions is required, however, which makes this alternative accessible at competitive costs with traditional sources of liquid mineral fuels.

A drawback which arises when clean middle distillates starting from Fischer-Tropsch synthesis products are desired, is the inevitable presence in the synthesis mixture of a significant quantity of oxygenated products, prevalently present in the form of alcohols, and linear olefins, together with the paraffinic part which generally forms from 90 to 99% of the product.

These by-products of the Fischer-Tropsch process are undesirable due to the negative influence they have in the upgrading steps of the hydrocarbon mixture to give, for example, middle distillates or lubricating oils. Alcohols can, in fact, contribute to reducing the activity of the hydrocracking catalyst and its lower stability over a period of time. Numerous schemes have been proposed for the treatment of F-T products, in order to improve both the yields and properties at low temperatures of the middle distillates coming from the Fischer-Tropsch synthesis.

Patent application EP-A 321,303 describes, for example, a process which comprises the separation of the light fraction (290−° C., rich in oxygenated compounds) of a hydrocarbon mixture from an F-T process, and sending the 290+° C. fraction to a hydrocracking/isomerization reactor for the production of middle distillates. The non-converted 370+° C. fraction can be recycled to the hydrocracking reactor or optionally sent, either totally or partially, to a second isomerization reactor for an additional production of kerosene and lube bases. The catalyst claimed for both reactors consists of platinum supported on fluorinated alumina. The examples provided indicate that by feeding the hydrocracking reactor with a 370+° C. charge, maximum yields of about 50% to middle distillate are obtained for a conversion level of the charge of 70 to 90%.

U.S. Pat. No. 5,378,348 describe a process in numerous steps for the treatment of paraffinic waxes which comprises the separation of the charge into three fractions:

1) naphtha ($C_5$-165° C.); 2) kerosene (160-260° C.); 3) residue (260+° C.).

The kerosene fraction is subjected to a two-step process: the first step is a bland hydrogenation treatment (commonly known as hydrotreating) to remove the olefins and oxygenated compounds; the second is a hydroisomerization step to improve the properties at low temperatures. The 260+° C. fraction is sent to a hydrocracking/isomerization reactor for the production of middle distillates, and the non-converted 370+° C. fraction is recycled. The advantages deriving from the use of this scheme are higher yields to middle distillates and their good properties at low temperatures. The preferred catalysts are based on a noble metal (Pt, Pd) or Ni+Co/Mo pairs on silica alumina or silica-alumina modified by impregnation of the carrier with a silica precursor (e.g. $Si(OC_2H_5)_4$). The examples relating to the conversion of the 260+° C. fraction, using various catalysts, indicate kerosene/gas oil ratios ranging from 0.63 to 1.1 for a 39-53% conversion of the 370+° C. fraction. The freezing points of the 160-260° C. cut range from −43 to −25° C. whereas the pour point of the 260-370° C. fraction varies from −3 to −27° C.

It has now been found, unlike what is so far known in this field, that the hydrocracking process of a mixture of essentially linear hydrocarbons can be advantageously carried out if said mixture comprises a wide molecular weight distribution, i.e. if the feeding mixture also comprises, in addition to long-chain hydrocarbons, or waxes, a fraction within the range of middle distillate compositions.

A first object of the present invention therefore relates to a process for the preparation of middle distillates substantially without oxygenated organic compounds, starting from a synthetic mixture of partially oxygenated, substantially linear hydrocarbons, containing at least 20% by weight of a fraction having a distillation temperature higher than 370° C.; said process comprising the following steps:

i) separating said mixture into at least one low-boiling fraction (B) richer in oxygenated compounds, and at least one high-boiling fraction (A) less rich in, preferably substantially without, oxygenated compounds;

ii) subjecting said fraction (B) to a hydrogenating treatment under such conditions as to avoid there being any substantial variation in its average molecular weight, to obtain a hydrogenated mixture of substantially non-oxygenated hydrocarbons;

iii) recombining at least a part of said hydrogenated mixture according to step ii) with said fraction (A), to form a mixture (C) of linear hydrocarbons with a reduced content of oxygenated hydrocarbons and subjecting said mixture (C) to a hydrocracking treatment in the presence of a suitable catalyst, so as to convert at least 40%, preferably from 60 to 95% of said high-boiling fraction into a fraction of hydrocarbons which can be distilled at a temperature lower than 370° C.;

iv) separating at least one fraction of hydrocarbons, from the product obtained in step (iii), whose distillation temperature is within the range of middle distillates.

Further objects of the present invention are evident from the present description and examples.

In order to further clarify the description and claims of the present patent application and specify its relative scope, the meaning of some of the terms used herein is defined below:

the term "distillation temperature", referring to a mixture of hydrocarbons, means, unless otherwise specified, the temperature or range of temperatures at the head of a typical distillation column from which said mixture is collected, at normal pressure (0.1009 MPa);

the definitions of the ranges always comprise the extremes, unless otherwise specified;

the term "hydrocracking" is used herein with the general meaning of high temperature catalytic treatment of a hydrocarbon mixture, in the presence of hydrogen, in order to obtain a mixture with a lower boiling point;

the terms "kerosene" and "gas oil", as used below, refer to two hydrocarbon fractions having a distillation range of 150 to 260° C. and 260 to 370° C. respectively, which together form the so-called middle distillate;

the terms "oxygen content", referring to a mixture or fraction of hydrocarbons, and "oxygenated", referring to an organic compound, always refer to organic oxygen, i.e. bound to at least one carbon atom, excluding therefore any reference to water or other inorganic compounds containing oxygen.

The mixture of substantially linear hydrocarbons suitable as feeding for the process according to the present invention can comprise up to 20%, preferably up to 10% by weight of a non-paraffinic organic fraction, and is characterized by a substantial absence of sulfur. In particular, its content of oxygenated organic compounds, such as alcohols or ethers, usually ranges from 0.1 to 10%, preferably from 1.0 to 5% by weight.

For an optimum embodiment of the process according to the present invention, said synthetic feeding mixture consists of at least 90% of linear paraffins having from 5 to 80, preferably from 10 to 65, carbon atoms, and a boiling point, correspondingly within the range of 35 to 675° C. (by extrapolation), preferably ranging from 170 to 630° C. (by extrapolation). Furthermore said feeding comprises at least 20%, preferably from 40 to 80% by weight, of a high-boiling fraction distillable at a temperature ≧370° C., and up to 80%, preferably from 55 to 20% by weight, of a hydrocarbon fraction corresponding to so-called "middle distillates", subdivided into the traditional kerosene and gas oil cuts, as previously defined, a light 150-° C. cut (naphtha and GPL) also being optionally present, preferably in a quantity of less than 5% by weight.

Processes, however, in which the feeding is different from those preferred specified above, are not excluded from the scope of the present invention. The mixtures of prevalently linear hydrocarbons having distillation ranges equal to or higher than 370° C. are solid or semisolid at room temperature, and for this reason are also commonly called waxes.

Typical examples of these mixtures are fractions deriving from the thermo-degradation of polyolefins, certain oil processing fractions and semi-solid mixtures of hydrocarbons obtained by the direct synthesis of synthesis gas, for example those obtained by means of the Fischer-Tropsch process.

The latter in particular are characterized by a substantial absence of sulfur and preferably consist of over 70% by weight of linear paraffins having more than 15 carbon atoms and a boiling point higher than 260° C. As already mentioned, these mixtures are frequently solid or semisolid at room temperature and are therefore defined as waxes. Not all Fischer-Tropsch processes provide mixtures of high-boiling linear paraffins. Depending on the conditions adopted and on the catalyst, Fischer-Tropsch processes can produce mixtures within different distillation temperature ranges, also relatively low, if desired. It has proved to be more convenient, however, to carry out the process so as to prevalently obtain high-boiling mixtures or waxes, which can then be suitably degraded and fractionated into the desired distillation cuts.

It is also known that processes of the Fischer-Tropsch type produce hydrocarbon mixtures containing oxygenated hydrocarbons, normally in the form of alcohols, whose content can generally reach a maximum of 10% by weight with respect to the total.

In the case of catalysts based on cobalt, these oxygenated compounds mainly consist of linear-chain alcohols, but may also comprise acids, esters and aldehydes in a much lower concentration (The Fischer Tropsch and Related Synthesis, H. H. Storch, N. Golumbic, R. B. Anderson, John Wiley & Sons, Inc., N.Y. 1951). It is generally known in the art that these oxygenated compounds are prevalently concentrated in the low-boiling fraction of a typical mixture obtained from the Fischer-Tropsch synthesis, whereas the fraction with a boiling point higher than 300° C., preferably higher than 370° C., has a content of organic oxygen not higher than 0.1% (expressed as weight of oxygen with respect to the total weight of the fraction).

According to step (i) of the process according to the present invention, said feeding hydrocarbon mixture, comprising most of the oxygenated compounds, is separated into two fractions having a different boiling point. In particular, the low-boiling fraction (B) preferably corresponds to a typical middle distillate cut, i.e. has a maximum boiling point ranging from 150 to 380° C., preferably from 260 to 370° C., whereas the remaining high-boiling fraction (A) contains the fraction of waxes with a boiling point generally higher than 370° C., but may also comprise at least a part, usually not more than 30% by weight of (A), of a typical gas oil cut, depending on the convenience and on the basis of the relative oxygen content. In general, the separation is preferably effected so that the oxygen content in the high-boiling fraction (A) is lower than 0.1%, more preferably lower than 0.01% by weight.

The separation of the fraction (A) from the fraction (B) can be carried out according to any of the known methods suitable for the purpose. A distillation is generally carried out at a suitable cut temperature ranging from 240 to 380° C., more preferably from 350 to 370° C., using a column or other suitable equipment available.

According to a preferred embodiment of the present invention, the separation step (i) of the synthetic mixture of hydrocarbons can either be carried out at the moment of synthesis itself by taking fraction (A) and fraction (B) from different points of the synthesis reactor, or in any of the subsequent steps before the hydrocracking step (iii). For example, if the mixture is obtained by Fischer-Tropsch synthesis, step (i) can also be accomplished by obtaining the two fractions as streams taken at two different heights of the Fischer-Tropsch synthesis reactor.

Step (ii) of the process according to the present invention consists in a hydrogenating treatment mainly aimed at removing the organic oxygen and unsaturations in the olefins and, if necessary, the partial isomerization of the charge.

The procedure for carrying out said hydrogenating treatment is well known in the art and has no particular critical aspects with respect to the process of the present invention, provided it is effected so that the degradation of the molecular weight of the fraction treated is practically negligible, and however with a conversion that is never higher than 15% to products included in the typical so-called naphtha cut, having a distillation temperature lower than 150° C. Step (ii) should therefore be carried out in such a way as to ensure that not more than 15%, preferably not more than 10% of the constituents (B) having a distillation temperature higher than 150° C., is converted to products with a lower distillation temperature.

Typical but non-limiting reaction conditions of step (ii) are: temperature ranging from 150 to 300° C., hydrogen pressure ranging from 0.5 to 10 MPa and space velocity (WHSV) ranging from 0.5 to 4 $h^{-1}$.

The hydrogen/charge ratio ranges from 200 to 2000 Nlt/Kg.

As is known, the hydrogenation reaction is carried out in the presence of a suitable catalyst. This, according to what is disclosed in the art, preferably comprises a metal of groups 8, 9 or 10 of the periodic table of elements, dispersed on a carrier preferably consisting of an inorganic oxide, such as alumina, titania, silico-alumina, etc. Preferred hydrogenation catalysts are those based on nickel, platinum or palladium, supported on alumina, silico-alumina, fluorinated alumina, with a concentration of the metal which, depending on the type, ranges from 0.1 to 70%, preferably from 0.5 to 10%, by weight.

The hydrogenated low-boiling mixture, as obtained according to the above step (ii), is then merged, at least partially, with the high-boiling fraction (A), which is not subjected to any hydrogenating pretreatment, to form said mixture (C) that is subsequently sent for hydrocracking treatment according to the following step (iii). Before forming said mixture (C), it is preferable, however, according to the present invention, to separate from the hydrogenated low-boiling fraction, any gases possibly present and, even more preferably, the water deriving from the hydrogenation of the oxygenated compounds originally present.

According to a preferred embodiment of the present invention, the non-reacted hydrogen and all the gaseous compounds having a boiling point lower than 60° C., i.e. essentially the $C_1$-$C_5$ (or $C_5$-) hydrocarbon fraction, are therefore separated from the reaction mixture obtained at the end of step (ii). This separation of the gases can be carried out, for example, depending on the technical plant requirements, either by simple flash treatment or by distillation. After separation, hydrogen is normally added of the corresponding amount consumed in the reaction and recycled, whereas the fraction of hydrocarbon gases is treated according to one of the methods normally applied, for example, it is sent to reforming for the production of synthesis gas, or used directly to produce energy.

The water formed during step (ii) is normally in a relatively negligible quantity, usually lower than 0.6% by weight in the reaction mixture. However it is preferable for it to be separated, especially if the catalyst of the subsequent hydrocracking step is sensitive to humidity. The separation of this small quantity of water can be effected according to any of the known methods suitable for the purpose, for example, by phase separation and decanting, or by distillation (preferably under slight vacuum at 100° C.), or again, by absorption with suitable drying agents or materials, such as certain anhydrous salts such as calcium sulfate, known in the art.

At the end of the above optional separation steps, the remaining liquid fraction is joined and mixed with the high-boiling fraction in such a quantity as to allow the subsequent hydrocracking step to be carried out under the desired optimum conditions. Preferably at least 50%, more preferably at least 95% by weight of the hydrogenated fraction is joined to said fraction (A), to form a mixture (C) which is subjected to hydrocracking. Said mixture (C) preferably has a water content of less than 0.1% by weight.

The hydrocracking step (iii), according to the present invention, is preferably carried out so as to obtain an a conversion level, as defined below, of at least 50%, more preferably at least 80%, in order to produce a middle distillate cut with high conversions and selectivities. For this purpose, the feeding mixture is put in contact with a suitable concentration of hydrogen, in the presence of a solid catalyst comprising an acid function and a hydro-dehydrogenating function.

The hydrocracking step (iii) of the process according to the present invention, is generally carried out at the temperatures and pressures of traditional processes of this type, known in the art. The temperatures are generally selected from 250 to 450° C., preferably from 300 to 370° C., whereas the pressure is suitably selected from 0.5 to 15 MPa, preferably from 1 to 10 MPa, also comprising the hydrogen pressure.

The hydrogen is used in a sufficient quantity to effect the desired conversion under the pre-established conditions. The mass ratio between hydrogen and hydrocarbons in the feeding (and its consequent relative pressure) can be easily selected by experts in the field in relation to the other essential process parameters, such as space velocity, contact time, catalyst activity and temperature, so as to reach the desired conversion level and product quality.

Initial mass ratios (hydrogen)/(hydrocarbons) ranging from 0.03 to 0.2, which however are not limiting of the present invention, are usually considered satisfactory for effecting the process. Under these conditions, only a small part of the hydrogen initially introduced is used up, the residual part can be easily separated and recycled with common equipment suitable for the purpose. Whereas in more general cases, the use of mixtures of hydrogen with inert gases such as nitrogen, for example, is not excluded, the use of essentially pure hydrogen, which, however, is commercially available at a low cost, is preferred.

The WHSV space velocity (defined as mass flow-rate in g/h divided by the weight of the catalysts in grams), or the contact time (defined as the reciprocal of the space velocity: 1/WHSV), of the reagents under the hydrocracking reaction conditions, are generally selected in relation to the characteristics of the reactor and process parameters in order to obtain the desired a conversion level. It is important for the contact time to be selected so that the $\alpha$ conversion level (370+° C. fraction mass in the charge less the 370+° C. fraction mass in the products, divided by the 370+° C. fraction mass in the charge) is maintained within the values over which undesired reactions which jeopardize the production of the desired selectivity levels to "middle distillate", become significant. Contact times are generally selected, which allow conversion levels of the high-boiling fraction (370+° C.) ranging from 60 to 95%, expressed as percentage weight ratio between the converted part of said 370+° C. fraction and the corresponding fraction present in the feeding.

$$\text{Conversion level } (\alpha)=100\cdot(370+_{feed}-370+_{outlet})/(370+_{feed})$$

In accordance with a typical embodiment of the process of the present invention, the mixture of hydrocarbons (C), obtained as described above, is preheated to a temperature ranging from 90 to 150° C., and fed in continuous, after premixing with the hydrogen, to a tubular fixed bed reactor operating in "down flow". The reactor is thermostat-regulated to a temperature of 300 to 360° C. The pressure of the reactor is maintained at 3 to 10 MPa.

According to this typical embodiment of the present invention, the catalyst is charged into the reactor in granular form, preferably as a co-extruded product with an inert material, for example $\gamma$-alumina. A fixed bed is normally used in which the reagent mixture is passed. The contact time is selected so as to have an $\alpha$ conversion level ranging from 60 to 90%, more preferably from 80 to 90%, with recycling of the non-converted fraction. The space velocity preferably ranges from 0.4 to 8 $h^{-1}$.

The catalyst used in said hydrocracking step (iii) of the present process, can be any hydro-dehydrogenation catalyst suitable for the purpose, having the known bifunctional characteristics mentioned above.

It generally consists of one or more metals of groups 8, 9 or 10 of the periodic table dispersed on the surface of a suitable inorganic porous carrier, which can generally have either an amorphous or crystalline or mixed structure, and is usually selected from metal oxides having neutral or weakly acid characteristics such as silica, alumina, silico-alumina, molecular sieves, zeolites, etc. According to what is known in the art, said inorganic porous solids can be treated with various procedures or modified by the addition of other components, in order to provide particular properties and selectivities. Carriers not subjected to impregnation with silicon compounds, however, are preferred.

Preferred carriers for the purpose consist of amorphous acids such as, for example, amorphous alumina silica, fluorinated alumina, silica deposited on alumina, mixtures of alumina and titanium oxide, sulfated zirconia, zirconia modified with tungsten or with other amorphous matrixes.

The metal with a hydro-dehydrogenating function can advantageously consist of a noble metal of group 10, such as, for example, Pt or Pd, or of a different metal of groups 8 or 9 of the periodic table, preferably combined with a second metal selected from those of group 6. Said metals are deposited and dispersed on the surface of the above acid carrier by means of any of the known techniques suitable for the purpose, for example by means of impregnation with a solution of said salt, and evaporation of the solvent. Before use, the catalyst requires an activation process, normally effected by means of contact with pure hydrogen at the pressures and temperatures normally adopted in hydrocracking reactions.

The concentration of the metal on the carrier is generally selected so as to reduce an excessive degradation of the charge. Suitable concentrations vary from 0.05 to 10% by weight of metal with respect to the weight of the catalyst, in relation to the process conditions, the type of carrier and activity of the metal itself. In the case of amorphous carriers, concentrations of noble metal ranging from 0.2% to 0.8% by weight have given extremely satisfactory results.

According to a preferred embodiment of the present invention, the hydrocracking step (iii) of said fraction (C) is effected in the presence of a bifunctional catalyst, in which a noble metal is supported on an amorphous and micro/mesoporous silica-alumina gel with a controlled pore size, having a surface area of at least 500 $m^2/g$ and with a molar ratio $SiO_2/Al_2O_3$ ranging from 30/1 to 500/1, preferably from 40/1 to 150/1, more preferably from 95/1 to 105/1. This carrier is normally obtained starting from a mixture of tetra-alkyl ammonium hydroxide, an aluminum compound hydrolyzable to $Al_2O_3$, a silicon compound hydrolyzable to $SiO_2$ and a sufficient quantity of water to dissolve and hydrolyze said compounds, wherein said tetra-alkyl ammonium hydroxide comprises from 2 to 6 carbon atoms in each alkyl residue; said hydrolyzable aluminum compound is preferably an aluminum trialkoxide comprising from 2 to 4 carbon atoms in each alkoxide residue and said hydrolyzable silicon compound is a tetra-alkylorthosilicate comprising from 1 to 5 carbon atoms for each alkyl residue.

Various methods are possible for obtaining different carriers, but having the above characteristics, as described, for example, in European patent applications EP-A 340,868, EP-A 659,478 and EP-A 812,804, whose contents are incorporated herein as reference. In particular, an aqueous solution of the above compounds is hydrolyzed and gelified by heating, both in a closed environment at the boiling point or higher, and also in an open environment below this temperature. The gel thus produced is subsequently subjected to drying and calcination according to the known methods, for example, by heating to temperatures ranging from 300-750° C. (preferably 500-600° C.), for a period ranging from 0.5 to 15 hours (preferably 2-6 hours), in an inert or oxidizing atmosphere, optionally in the presence of a quantity of vapour of up to 30% by volume.

The silica and alumina gel (silico-alumina) thus obtained has a composition corresponding to that of the reagents used, considering that the reaction yields are practically complete. This gel is amorphous, when subjected to X-ray diffraction analysis from powders, it has a surface area of at least 500 $m^2/g$, normally within the range of 600-850 $m^2/g$ and a pore volume of 0.4-0.8 $cm^3/g$. A metal selected from noble metals of groups 8, 9 or 10 of the periodic table is supported on the amorphous micro/mesoporous silica/alumina gel obtained as described above. Said metal is preferably selected from platinum or palladium, and particularly platinum.

According to the present invention, it is convenient for the metal to be uniformly distributed on the porous surface of the carrier, so as to maximize the catalytic surface effectively active. For this purpose, various known methods are used, such as those described, for example, in European patent application EP-A 582,347, and especially in patent application EP-A 1,101,813, whose contents are incorporated herein as reference. In particular, according to this impregnation method, the porous carrier having the characteristics of the acid carrier described above, is put in contact with an aqueous or alcohol solution of a compound of the desired metal for a period which is sufficient to provide a homogeneous distribution of the metal in the solid. This normally requires from a few minutes to several hours, preferably under stirring. Soluble salts suitable for the purpose are, for example, $H_2PtF_6$, $H_2PtCl_6$, $[Pt(NH_3)_4]Cl_2$, $[Pt(NH_3)_4](OH)_2$ and the analogous palladium salts; mixtures of salts also of different metals are equally included in the scope of the invention. The minimum quantity of aqueous liquid is conveniently used (usually water or an aqueous mixture with a second inert liquid or with an acid in a quantity of less than 50% by weight), which is sufficient to dissolve the salt and uniformly impregnate said carrier, preferably with a solution/carrier volumetric ratio ranging from 1 to 3. The quantity of metal is selected on the basis of the desired concentration thereof to be obtained in the catalyst, as the whole metal is fixed to the carrier. In order to increase the dispersion of the metal on the surface, the impregnation is preferably effected within an acid pH range, with values selected in relation to the characteristics of the carrier and acid-base strength of the noble metal salt so as to favour the ionic interaction between surface and metallic ion.

At the end of the impregnation, the solution is evaporated and the solid obtained is dried and calcined in an inert or reducing atmosphere, under temperature and time conditions analogous to those specified above for the calcination of the carrier.

An alternative method to impregnation is by ionic exchange. According to the latter, the amorphous silica/alumina gel carrier is put in contact with an aqueous solution of a metal salt as in the above case, but the deposition takes place by exchange under conditions made basic (pH between 8.5 and 11) by the addition of a sufficient quantity of an alkaline compound, normally an ammonium hydroxide. The suspended solid is then separated from the liquid by filtration or decanting and dried and calcined as specified above.

According to another preferred embodiment of the present invention, the hydrocracking catalyst used in step (iii) is a catalyst according to European patent application EP 701,480, whose contents are incorporated herein as reference. In particular, this catalyst comprises (and preferably essentially consists of) from 0.05% to 10% by weight of at least one noble metal of group 10 of the periodic table (preferably Pt or Pd) deposited on an amorphous silica-alumina carrier (preferably containing from 5 to 95% by weight of silica) having a specific surface area ranging from 100 to 500 $m^2/g$, an average pore diameter ranging from 1 to 12 nm and such that the overall volume of the pores, whose diameter is equal to the average diameter, more or less 3 nm, represents at least 40% of the total pore volume, a dispersion of the noble metal ranging from 20 to 100%, and a distribution coefficient of the metal greater than 0.1.

According to another preferred embodiment of the present invention, the hydrocracking reaction of step (iii) is carried out in the presence of a catalyst according to European patent application EP 1,048,346, whose contents are incorporated herein as reference. In particular, this catalyst comprises (and preferably essentially consists of) from 0.05% to 10% by weight of at least one noble metal of group 10 of the periodic table (preferably Pt or Pd) deposited on an amorphous acid carrier not containing molecular sieves (for example one of those describe above, preferably amorphous silico-alumina) having a specific surface area ranging from 100 to 500 $m^2/g$ (preferably from 250 to 450 $m^2/g$) and a porosity (total pore volume) generally lower than 1.2 ml/g (preferably ranging from 0.3 to 1.1 ml/g), said catalyst having a dispersion of the noble metal not higher than 20% (preferably ranging from 1 to 20%), and a distribution coefficient of the metal greater than 0.1 (preferably greater than 0.5). Even more preferably, said catalyst is characterized by not more than 2% by weight of the noble metal present in particles with a diameter of less than 2 nm, as measured by means of electronic transmission microscopy, whereas the number of particles of noble metal which have a diameter of over 4 nm is at least 70% (preferably at least 80%) with respect to the total.

According to a further preferred embodiment of the present invention, the hydrocracking reaction of step (iii) is carried out in the presence of a catalyst comprising at least one metal or a mixture of metals having a hydro-dehydrogenating function, of the type, form and in the quantities described above, deposited and/or dispersed on a carrier comprising, or essentially consisting of, at least one silico-alumina having the following characteristics:

- a silica content ranging from 10 to 60% by weight, preferably from 20 to 60% by weight and even more preferably from 30 to 50% by weight, with respect to the total silico-alumina;
- a sodium content lower than 300 ppm by weight, preferably lower than 200 ppm by weight;
- a specific surface higher than 200 $m^2/g$, preferably higher than 250 $m^2/g$;
- a total pore volume ranging from 0.5 to 1.2 ml/g, as measured by mercury porosimetry;
- the porosity of said silico-alumina being as follows:
  - (i) the mesopore volume, whose diameter ranges from 4 to 15 nm, and whose average diameter varies within the range of 8 to 12 nm, represents from 30 to 80%, preferably from 40 to 70% of the total pore volume defined above;
  - (ii) the macropore volume, whose diameter is higher than 50 nm, preferably from 100 to 1000 nm, represents from 20 to 80%, preferably from 30 to 60%, of the total pore volume.

Said silico-alumina has an X-ray diffraction spectrum corresponding to a mixture of silica and gamma-alumina. It can be easily obtained using the normal known preparation techniques of porous oxides, and particularly silico-aluminas, and is available as a commercial product.

According to a typical and preferred embodiment of the present invention, said hydrocracking catalysts comprising an amorphous silico-alumina carrier do not contain significant quantities of added halogen atoms, especially fluorine and chlorine, in addition to those possibly contained in the noble metal salts used for the impregnation and deposition of said metal on the active carrier.

The supported catalyst, suitable for the hydrocracking step (iii) according to the present process, can comprise the active carrier as such as described above, or, preferably, said carrier is reinforced by the addition and mixing of a suitable quantity of ligand consisting of an inorganic inert solid capable of improving its mechanical properties, such as, for example, silica, alumina, clay, titanium oxide ($TiO_2$) or zirconium oxide ($ZrO_2$), boron oxide ($B_2O_3$), or mixtures thereof. The catalyst, in fact, is preferably used, after activation by reduction according to one of the known methods and/or described below, in granular form rather than in powder form, with a relatively narrow particle-size distribution. Furthermore, it conveniently has sufficient mechanical compression resistance and impact strength to avoid progressive crumbling during the hydrocracking step.

Preferred ligands are silica and alumina, and particularly alumina in all its known forms, for example gamma alumina.

Said reinforced carrier and/or catalyst can be obtained using any of the mixing, extrusion and pelletizing methods of solid materials in mixtures, for example, according to the methods described in European patent applications EP-A 550,922 and EP-A 665,055, the latter being preferred, both filed by the Applicant, whose contents are incorporated herein as reference.

In this way, a granular acid carrier is obtained, containing a quantity of 1 to 70% by weight, preferably from 20 to 50% by weight, of inert inorganic ligand, the remaining quantity consisting of amorphous silica-alumina essentially having the same porosity, surface extension and structure described above for the same gel without ligand. The granules are conveniently cylindrically-shaped (pellets) with a diameter of about 2-5 mm and a length of 2-10 mm.

The supporting of the hydro-dehydrogenating metal on the reinforced granular acid carrier, prepared as described above, is then effected with the same procedure mentioned above, or, alternatively, it can be effected on the active carrier before adding the ligand and extruding the resulting mixture. Impregnation subsequent to the reinforcement and extrusion of the carrier is however preferred for the purposes of the present invention when the active phase consists of amorphous silica-alumina.

Continuing now with the detailed description of the process according to the present invention, the reaction mixture leaving the hydrocracking reactor is sent to a distillation/separation step (iv) from which the desired middle distillate product is obtained, possibly divided in the two fractions of kerosene and gasoil, operating according to the known art. The high-boiling residue, normally consisting of partly isomerized hydrocarbon waxes, can be advantageously recycled to the hydrocracking step to produce additional middle distillate. The light hydrocarbon fraction (gas and naphtha) with a distillation temperature lower than 150° C., is removed from the head of the column and destined for various uses.

According to a particular embodiment of the present invention, a portion of the kerosene and/or gas oil, preferably less than 50%, more preferably less than 30%, by weight of the total middle distillate recovered from the distillation step (iv), can also be recycled to the hydrocracking step (iii), preferably after merging with said mixture (C), in order to undergo further hydrocracking/hydroisomerization. It has been found that such a partial recycle, particularly in the case of kerosene, allows improved cold properties to be obtained.

According to the present invention, the middle distillate thus produced is obtained with very high yields, usually higher than 70% and preferably higher than 80% by weight, in the case of total recycling of the non-converted fraction, calculated as percentage ratio between the weight of middle distillate in the product (gas oil+kerosene) and the weight of the 150+° C. fraction in the feeding mixture of step (i). A very reduced quantity of hydrocarbons with a boiling point lower than 150° C. is therefore produced, even though practically the whole fraction or feeding mixture is subjected to hydrocracking in a single step and with a high conversion level, whereas the most recent known art uses two separate isomerization/hydrocracking steps, with a considerable increase in the complexity and plant costs necessary for effecting the process.

The process according to the present invention also allows said mixture of partially oxygenated, linear high-boiling hydrocarbons to be transformed, with excellent yields, into a middle distillate having an optimum combination of properties in terms of isomerized fraction, kerosene/gas oil ratio, cetane number and properties at low temperatures (pour point, freezing point, etc.). Furthermore it is also possible with this process to conveniently effect the recycling of the non-converted high-boiling residue.

BRIEF DESCRIPTION OF THE DRAWINGS

For an even more detailed description of the present invention, reference is made to FIG. 1, which schematically represents a preferred embodiment of the process, object of the invention.

In accordance with the plant scheme of FIG. 1, a synthetic stream of substantially linear hydrocarbons, partially oxygenated and essentially sulfur-free, obtained for example from a process of the Fischer-Tropsch type, preferably of the non-shifting type, is removed from the synthesis reactor already subdivided into a high-boiling fraction (A), with an initial boiling point ranging from 250 to 400° C., and a low-boiling fraction (B), with a final boiling point ranging from 200 to 450° C. The mass ratio (B)/(A) between the two fractions is preferably within the range of 0.5 to 2.0, more preferably from 0.8 to 1.5, and if necessary, the composition of the two fractions can be partly coinciding, with a hydrocarbon cut present in both fractions, preferably in a quantity ranging from 0.1 to 20% by weight with respect to the total weight of each fraction.

The low-boiling fraction (B) is fed, by means of line 1, to the hydrogenation unit (HDT) for effecting step (ii) of the process according to the present invention, in which it is put in contact with hydrogen (line 2) in the presence of a suitable catalyst, under such conditions as to minimize or exclude the hydrocracking reaction. The hydrogenation unit (HDT) can be carried out according to the known art and preferably comprises a pressure reactor containing a catalyst on a fixed bed selected from those suitable for the purpose mentioned above.

According to a particular embodiment, said catalyst can also coincide with that used for the hydrocracking step (iii), but under blander conditions, so as to essentially or prevalently reduce the catalytic function to hydrogenation alone, or to hydrogenation with partial isomerization.

The isomerization extension in the hydrogenation step (ii) depends on the type of catalyst used in this step and on the operating conditions, and advantageously ranges from 2 to 40%, preferably 5-30%, by weight of branched hydrocarbons produced, with respect to the total weight of the fraction fed.

A fraction of hydrocarbons is produced from the hydrogenation step, having an oxygen content lower than 0.001% by weight, from which the fraction of $C_5$-gaseous hydrocarbons (boiling point lower than 40° C.) possibly present, is advantageously separated and removed, by means of line 5, which however does not represent more than 5%, preferably not more than 3% by weight of the whole fraction (B).

Figure 1:
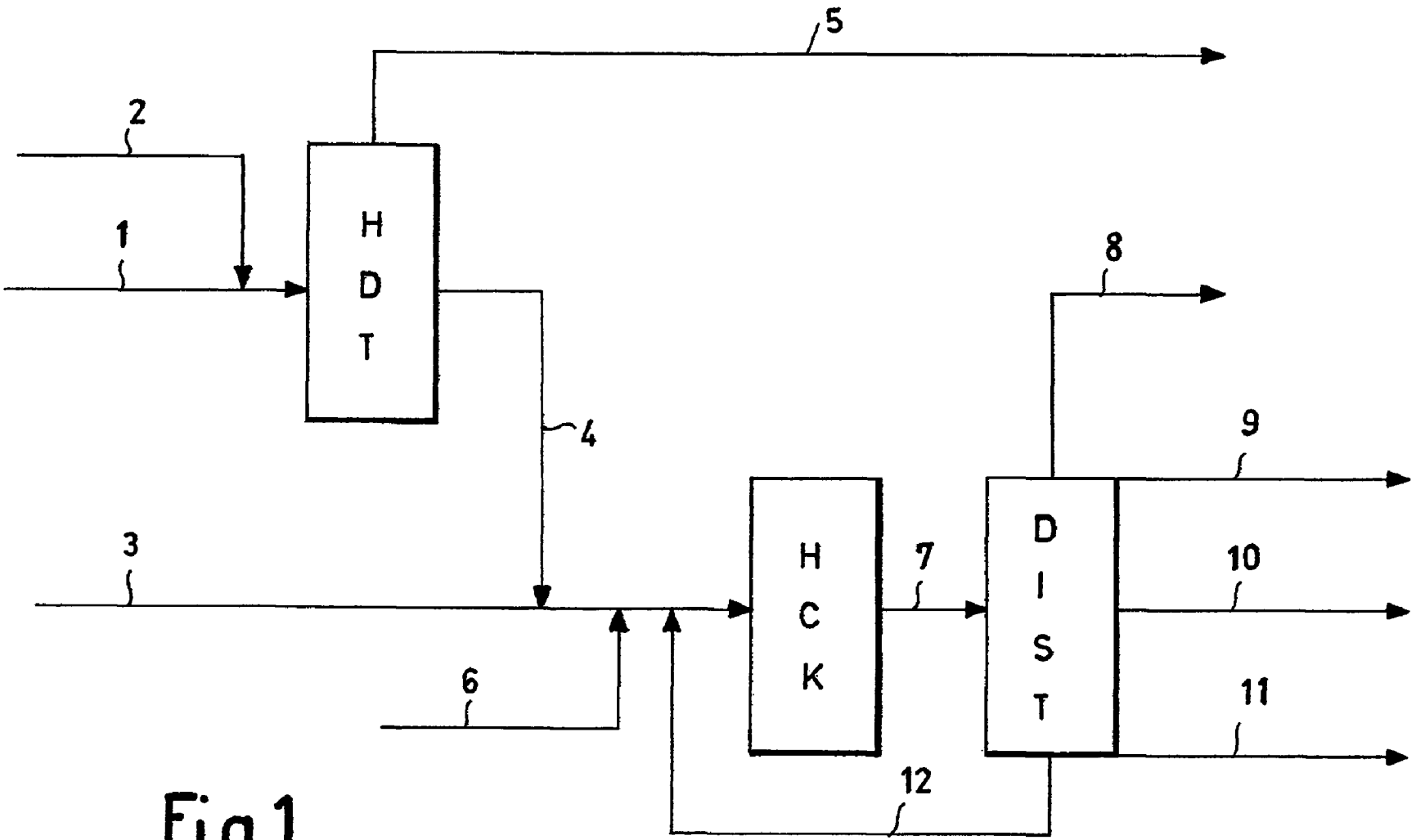

According to a particularly preferred aspect, at least a part, and more preferably at least 90% of the water formed by hydrogenation of the oxygenated hydrocarbons, is also separated in this step, and is consequently distilled, or decanted, or absorbed by contact with suitable drying materials, in an apparatus not shown in FIG. 1.

A low-boiling fraction is thus obtained, essentially consisting of a mixture of saturated hydrocarbons, preferably partially isomerized, which is at least partly, preferably completely, joined by means of line 4 to the above fraction (A) (line 3) of high-boiling hydrocarbons with a low oxygen content, to form a charge (C) which is fed to the hydrocracking unit (HCK) according to step (iii) of the present process.

The following streams are fed as a whole to the hydrocracking unit (HCK):

- the charge (C), obtained from the joining of the above high-boiling fraction (A) and of the fraction resulting from the hydrogenating pretreatment of the low-boiling fraction (B), by means of line 4;
- the recycled high-boiling fraction by means of line 12, preferably having a boiling point higher than 360° C., forming the residue of the subsequent separation of the middle distillate, in a mass ratio preferably ranging from 1 to 40%, more preferably from 5 to 15% with respect to said charge (C);
- a sufficient quantity of hydrogen, according to what is specified above, by means of line 6.

The reaction product of the hydrocracking step, consisting of a mixture of hydrocarbons having an isomerization degree (non-linear hydrocarbon mass/mixture mass) preferably greater than 50%, more preferably greater than 70%, is fed, by means of line 7, to a separation step by distillation (DIST), preferably in a suitable column operating at atmospheric pressure or slightly higher, from which the distillates of interest are removed by means of lines 10 (kerosene) and 11 (gas oil). The following products are also obtained from the DIST unit, in FIG. 1: a $C_1$-$C_5$ gaseous fraction, relatively insignificant, by means of line 8, and a light hydrocarbon fraction, by means of line 9, preferably with a boiling point lower than 150° C. (naphtha), which is formed in step (iii).

According to a particularly advantageous aspect of the present invention, the use of the above preferred catalysts in the hydrocracking step (iii) allows the quantity of naphtha produced, to be significantly reduced, preferably to less than 20%, more preferably to less than 15%, by weight with respect to the charge (C) fed, at the same time maintaining a balanced ratio between the two kerosene and diesel cuts of greater interest. In particular, it has been surprisingly found that the combination of these catalysts with a feeding having a wide molecular weight distribution allows both kerosene and diesel to be obtained, with a single hydrocracking/hydro-isomerization step, with high conversion levels of the high-boiling fraction (A) and keeping the K/D (kerosene/diesel) ratio relatively constant during the reaction. It has been found, in fact, that the $K_0/D_0$ ratio in the charge (C) differs by 20% at the most from the $K_F/D_F$ ratio in the product. It is thus possible to carry out the hydrocracking step on the whole charge fed, including the low-boiling fraction, without significantly increasing the quantity of naphtha normally produced when treating the high-boiling fraction alone, and at the same time overcoming the drawbacks deriving from possible deactivating effects of the alcohols on the catalyst.

Figure 2:
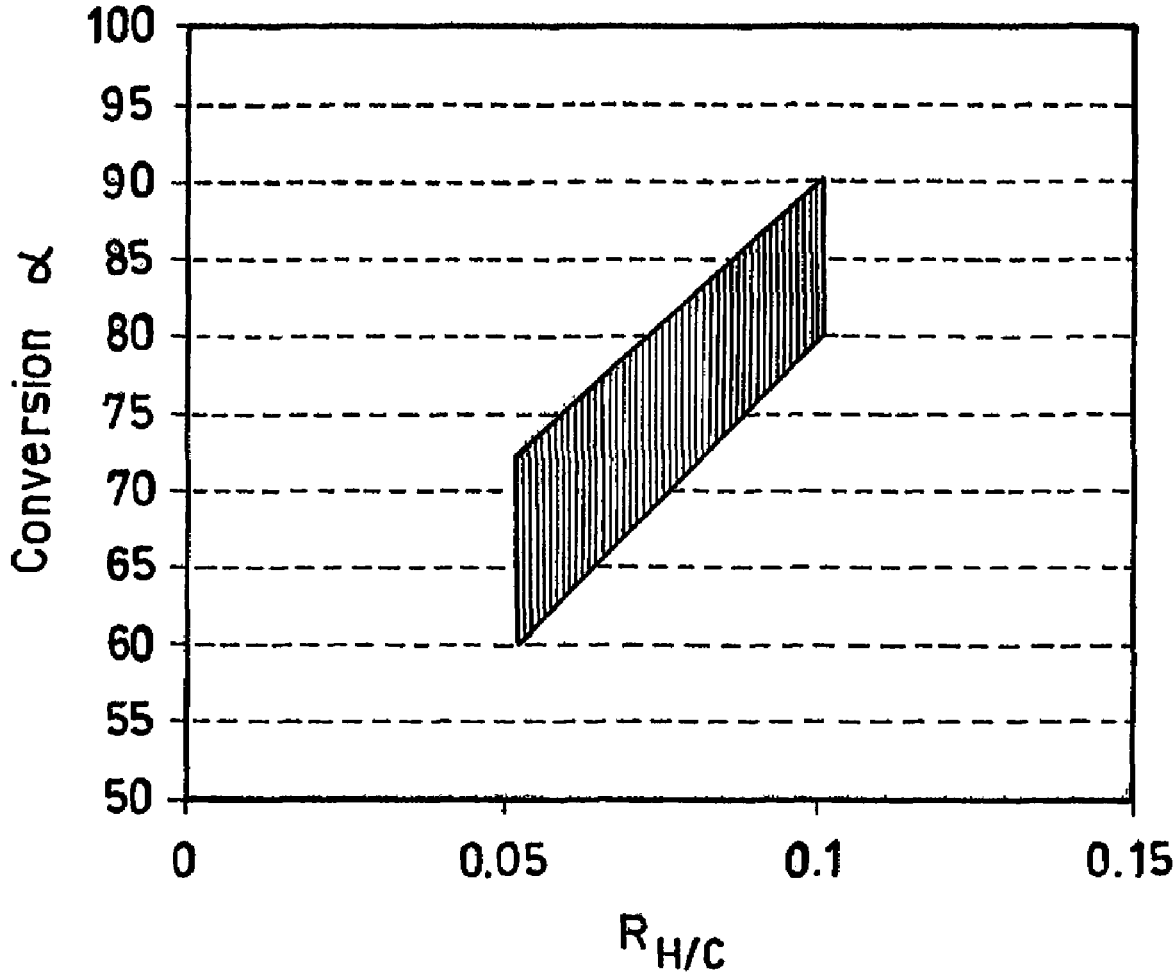

Particularly preferred conditions for effecting the hydrocracking reaction in step (iii) of the present process are those wherein the $\alpha$ conversion level (as defined above) and the hydrogen/$R_{H/C}$ hydrocarbon ratio in the feeding have values within the shaded area between points ABCD, indicated in FIG. 2.

FIG. 2 represents a diagram of the preferred $\alpha$ and $R_{H/C}$ values for carrying out the hydrocracking reaction in step (iii) of the process according to the present invention. The $\alpha$ conversion level scale is indicated in the ordinate, whereas the scale of $R_{H/C}$ ratios is indicated in abscissa. The shaded area defined by points ABCD, in the form of a distorted parallelogram, represents the combination of the preferred $\alpha$ and $R_{H/C}$ values.

The process according to the present invention therefore allows middle distillates having excellent properties at low temperatures, to be effectively produced with a high yield, starting from partially oxygenated and prevalently high-boiling synthetic charges, essentially using a single hydrocracking/hydro-isomerization step.

Some examples of an embodiment of the process, object of the present invention, are provided for purely illustrative and non-limiting purposes.

EXAMPLES

The following analysis and characterization methods were used:

- X-ray diffractometry from powders (XRD) to determine the residual crystallinity of the amorphous catalyst carrier: the analysis was carried out using a vertical Philips diffractometer equipped with a proportional impulse counter; the radiation was CuK$\alpha$ ($\lambda$=1.54178 Å).
- Pore volume measurement: the total pore volume was determined by means of the DFT (density functional theory) method.
- Specific surface area measurement: the specific surface area was evaluated by means of a BET linear graph with two parameters within the p/p° 0.01-0.2 range and by means of the DFT (density functional theory) method.
- Breaking load measurement: the axial and radial breaking loads were measured on a single pellet of catalyst using a QUESTAR-90 instrument produced by Stevens. The data indicated are an average of 20 determinations.
- Pour point: according to the regulation ASTM D97.
- Freezing point: according to the regulation ASTM D5901
- Smoke point: according to the regulation ASTM D1322
- Blending cetane number: obtained by calculation starting from the data obtained according to regulation ASTM D613 with mixtures having different gas oil contents coming from the hydrocracking process of waxes.

Reagents and Materials

During the preparations specified in the examples, the following commercial reagents were used:

| | |
|---|---|
| tetrapropylammonium hydroxide (TPA-OH) | SACHEM |
| aluminum tri-isopropoxide | FLUKA |

-continued

| | |
|---|---|
| tetra-ethylsilicate | DYNAMIT NOBEL |
| alumina (VERSAL 250, Pseudo-Bohemite) | LAROCHE |
| methylcellulose (METHOCEL) | FLUKA |

The reagents and/or solvents adopted and not indicated above are those commonly used and can be easily found at the usual commercial operators specialized in the field.

Preparative Example 1

Preparation of the Catalyst

In the following examples, a bifunctional catalyst was used, prepared according to the procedure described in "Preparative Example 1" of published European patent application EP 1,101,813. The characteristics of this catalyst are as follows:

59.8% by weight of silico/amorphous alumina (molar ratio $SiO_2/Al_2O_3$=102)
39.9% by weight of alumina (pseudo-bohemite)
0.3% by weight of platinum
Pore volume: 0.6 ml/g
BET: 600 $m^2/g$
Crushing strength: 10 $kg/cm^2$ (radial); 90 $kg/cm^2$ (axial).

Before its use, the catalyst is subjected to activation in a reducing atmosphere according to the method described below:

1) 2 hours at room temperature in a stream of nitrogen;
2) 2 hours at 50° C. in a stream of hydrogen;
3) heating to 310-360° C. with an increase of 3° C./min in a stream of hydrogen;
4) temperature constant at 310-360° C. for 3 hours in a stream of hydrogen and cooling to 200° C.

During the activation the pressure in the reactor is maintained at 3.0 to 8.1 MPa (30 and 80 atm).

Example 1

A semisolid mixture (waxes) of linear aliphatic hydrocarbons having the composition indicated in Table 1 below, coming from a synthesis process of the Fischer-Tropsch type, is subjected to a treatment according to the process of the present invention.

TABLE 1

| | Fraction (A) | Fraction (B) | Line 4 |
|---|---|---|---|
| Fraction <150° C. | 0 | 2 | 7 |
| Kerosene (from 150 to 260° C.) | 1 | 45 | 47 |
| Gas oil (from 260 to 370° C.) | 24 | 48 | 45 |
| Fraction >370° C. | 75 | 5 | 1 |
| Alcohols (weight %) | 1 | 9 | 0 |

122335 kg/h of the above mixture derive from a Fischer-Tropsch synthesis process subdivided into two fractions (A) and (B), high-boiling 360+° C. and low-boiling 360−° C. respectively, taken at two different heights of the reactor, having the compositions indicated in Table 1.

With reference to FIG. 1, 48468 kg/h of fraction (B) are fed from line 1 to the hydrogenation unit (HDT). 2.2000 kg/h of hydrogen are fed, from line 2, to the same unit. The hydrogenation unit (HDT) consists of a trickle-bed down reactor which operates at a temperature of 290° C., a pressure of 5 MPa and with a WHSV of 1.5 $h^{-1}$. The hydrogenation is carried out in the presence of the catalyst prepared as specified above according to preparative example 1, which, used under the above conditions, essentially produces only hydrogenation. 47288 kg/h of a mixture of hydrocarbons substantially without organic oxygen, whose distribution of the various cuts is indicated in Table 1, are removed, by means of line 4, from the hydrogenation unit (HDT). The isomerization degree of the mixture is 31%.

The distribution of the hydrogenated mixture substantially coincides with the low-boiling feeding mixture (B), as the HDT unit practically does not produces any hydrocracking. 1180 kg/h of a gaseous fraction consisting of a mixture of $C_1$-$C_5$ hydrocarbons are removed from the same unit (line 5).

The hydrogenated fraction coming from line 4 is joined to the high-boiling fraction (A) (line 3), having a flow-rate of 73866 kg/h, and the two joined mixtures, forming the charge (C), are sent to the hydrocracking unit (HCK) together with 8310 kg/h of a residual recycled fraction coming from the subsequent distillation unit (line 12).

Said HCK unit consists of a fixed bed trickle-bed reactor which operates at a temperature of 354° C., a pressure of 53 atm, and with a WHSV of 1.5 $h^{-1}$ comprising the catalyst obtained as described above according to preparative example 1. Hydrogen is sent to the same unit, by means of line 6, with a flow-rate of 6779 kg/h. During the hydrocracking only a small part of the hydrogen fed is used up whereas the remaining quantity is recovered and recycled.

A stream (line 7) is obtained from the hydrocracking unit, which is sent directly to a distillation and fractionation column (DIST), operating at atmospheric pressure.

A $C_1$-$C_6$ gaseous stream (line 8), a light stream (line 9) consisting of naphtha, susceptible to further transformations, a stream essentially consisting of kerosene (line 10) and one consisting of gas oil (line 11) are respectively removed from this column. The residue, having a boiling point higher than 360° C., is recycled to the HCK unit by means of line 12. The composition, flow-rate and main characteristics of the different fractions removed are indicated in Table 2.

TABLE 2

| Line-Fraction | Flow-rate (Kg/h) | Wt % | Properties | |
|---|---|---|---|---|
| 8-GPL ($C_1$-$C_5$) | 7802 | 6.02 | | |
| 9-naphtha ($C_6$-$C_9$) | 15604 | 12.05 | | |
| 10-kerosene ($C_{10}$-$C_{14}$) | 44276 | 34.2 | F.P. = −48° C. | Smoke Point: >42 mm |
| 11-gas oil ($C_{15}$-$C_{22}$) | 53468 | 41.3 | CFPP = −23° C. | BCN = 76 |
| 12-residue ($C_{23+}$) | 8310 | 6.4 | | |

Example 2

Comparative

A production process of middle distillates was carried out starting from the same composition of streams (A) and (B), and with the same operating conditions as the HDT and HCK units used in example 1, with the only difference that the hydrogenated stream coming from (B) was joined to the stream coming from the hydrocracking of (A) before the distillation unit, i.e. line 4 was sent to line 7 instead of line 3.

At the end, the streams having the composition and properties indicated in Table 3 below, were obtained.

TABLE 3

| Line-Fraction | Flow-rate (Kg/h) | Wt % | Properties | |
|---|---|---|---|---|
| 8-GPL ($C_1$-$C_5$) | 5320 | 4.11 | | |
| 9-naphtha ($C_6$-$C_9$) | 1184 | 9.15 | | |
| 10-kerosene ($C_{10}$-$C_{14}$) | 38624 | 29.9 | F.P. = −34° C. | Smoke Point: >42 mm |
| 11-gas oil ($C_{15}$-$C_{22}$) | 64965 | 50.2 | CFPP = −18° C. | BCN = 76 |
| 12-residue ($C_{23+}$) | 8724 | 6.7 | | |

As can be observed, on carrying out the hydrocracking reaction on the high-boiling fraction (A) alone, in the absence of the low-boiling components obtained after the hydrogenation of (B), the same advantageous properties obtained according to the previous example 1, in accordance with the present invention, are not produced.

The invention claimed is:

1. A process for the preparation of middle distillates substantially without oxygenated organic compounds, starting from a synthetic mixture of partially oxygenated, substantially linear hydrocarbons, containing at least 20% by weight of a fraction having a distillation temperature higher than 370° C.; said process comprising:

(i) separating said mixture into at least one low-boiling fraction (B) richer in oxygenated compounds, and at least one high-boiling fraction (A) less rich in oxygenated compounds;

(ii) subjecting said fraction (B) to a hydrogenating treatment under such conditions as to avoid any substantial variation in its average molecular weight, to obtain a hydrogenated mixture of substantially non-oxygenated hydrocarbons;

(iii) recombining at least 50% by weight of said hydrogenated mixture obtained in (ii) with said fraction (A), to form a mixture (C) of linear hydrocarbons with a reduced content of oxygenated hydrocarbons and subjecting said mixture (C) to a hydrocracking treatment in the presence of a suitable catalyst, so as to convert at least 40% of said high-boiling fraction into a fraction of hydrocarbons which can be distilled at a temperature lower than 370° C.;

(iv) separating at least one fraction of hydrocarbons, from the product obtained in (iii), whose distillation temperature is within the range of middle distillates.

2. The process according to claim 1, wherein said synthetic mixture of hydrocarbons contains from 1.0 to 10% by weight of oxygenated organic compounds.

3. The process according to claim 1, wherein said synthetic mixture of hydrocarbons is the product of a synthesis process of the Fischer-Tropsch type.

4. The process according to claim 1, wherein said synthetic mixture of hydrocarbons consists of over 70% by weight of linear paraffins having more than 15 carbon atoms and a boiling point higher than 260° C.

5. The process according to claim 1, wherein, in (i), said high-boiling fraction (A) has an oxygen content lower than 0.1%.

6. The process according to claim 1, wherein, in (i), said high-boiling fraction (A) has a boiling point of 370° C. or higher.

7. The process according to claim 1, wherein, in (i), said high-boiling fraction (A) comprises up to 30% by weight of a gas oil cut.

8. The process according to claim 1, wherein, said synthetic mixture of hydrocarbons is produced in a reactor from which said fraction (A) and said fraction (B) of (i) are obtained by removing each fraction from a different point thereof.

9. The process according to claim 1, wherein the hydrogenated mixture of hydrocarbons produced in (ii) has an oxygen content lower than 0.001% by weight.

10. The process according to claim 1, wherein a fraction of $C_5$-gaseous hydrocarbons is separated from said hydrogenated mixture of hydrocarbons of (ii), before the formation of any said mixture (C).

11. The process according to claim 1, wherein, in (ii), not more than 15% of the constituents of (B) having a distillation temperature higher than 150° C., is converted to products having a distillation temperature lower than 150° C.

12. The process according to claim 1, wherein, in (ii), the hydrogenation treatment comprises putting said fraction (B) in contact with hydrogen in the presence of a suitable catalyst, at a temperature ranging from 150 to 300° C., a hydrogen pressure ranging from 0.5 to 10 MPa and a space velocity (WHSV) ranging from 0.5 to 4 $h^{-1}$, with a hydrogen/charge ratio ranging from 200 to 2000 Nlt/Kg.

13. The process according to claim 12, wherein said catalyst comprises a metal selected from nickel, platinum or palladium, supported on a metallic oxide consisting of alumina, silico-alumina or fluorinated alumina.

14. The process according to claim 12, wherein said catalyst is selected from the hydrocracking catalysts used in (iii).

15. The process according to claim 14, wherein said catalyst has the same characteristics and properties as the catalyst used in (iii).

16. The process according to claim 1, wherein the hydrogenation mixture of hydrocarbons produced in (ii) has an isomerization extension ranging from 2 to 40% by weight of branched hydrocarbons produced, with respect to the total weight of the fraction fed (B).

17. The process according to claim 1, wherein, in (iii), the whole hydrogenated fraction coming from (ii) is joined to said fraction (A).

18. The process according to claim 1, wherein said fraction (C) has a water content lower than 0.1% by weight.

19. The process according to claim 1, wherein, in said hydrocracking treatment in (iii), an $\alpha$ conversion level of the 370° C. fraction of at least 50%, is obtained.

20. The process according to claim 19, wherein said hydrocracking $\alpha$ conversion level in (iii) ranges from 60 to 95%.

21. The process according to claim 1, wherein said hydrocracking process in (iii) is carried out at a temperature ranging from 250 to 450° C., a pressure ranging from 0.5 to 15 MPa, also comprising the hydrogen pressure, an initial mass ratio (hydrogen)/(hydrocarbons) ranging from 0.03 to 0.2, and a WHSV space velocity ranging from 0.4 to 8 $h^{-1}$.

22. The process according to claim 1, wherein said hydrocracking process in (iii) is carried out under such conditions that said a conversion level and the hydrogen/$R_{H/C}$ ratio in the feeding have any of the pairs of values that define the points within the shaded area between points ABCD, indicated in FIG. 2.

23. The process according to claim 1, wherein said hydrocracking process in (iii) is carried out in the presence of a bifunctional catalyst comprising an acid function and a hydro-dehydrogenating function.

24. The process according to claim 23, wherein said catalyst comprises a metal of groups 8, 9 or 10 of the periodic table, dispersed on a carrier selected from porous metal oxides having neutral or weakly acid characteristics.

25. The process according to claim 23, wherein said catalyst comprises platinum or palladium dispersed on a carrier consisting of an amorphous metallic oxide having acid characteristics.

26. The process according to claim 23, wherein said metal in the hydrocracking catalyst has a concentration ranging from 0.05 to 10% by weight.

27. The process according to claim 24, wherein said carrier is an amorphous and micro/mesoporous silica-alumina gel with a controlled pore size, a pore volume of 0.4-0.8 $cm^3/g$, a surface area of at least 500 $m^2/g$ and a molar ratio $SiO_2/Al_2O_3$ ranging from 30/1 to 500/1.

28. The process according to claim 26, wherein said catalyst comprises an amorphous silica-alumina carrier having a specific surface area ranging from 100 to 500 $m^2/g$, an average pore diameter ranging from 1 to 12 nm and such that the overall pore volume, whose diameter is equal to the average diameter, more or less 3 nm, represents at least 40% of the total pore volume, and has a dispersion of the noble metal ranging from 20 to 100%, and a distribution coefficient of the metal greater than 0.1.

29. The process according to claim 26, wherein said catalyst comprises an amorphous acid carrier not containing molecular sieves, having a specific surface area ranging from 100 to 500 $m^2/g$ and a porosity lower than 1.2 ml/g, and said catalyst has a dispersion of the noble metal ranging from 1 to 20% and a distribution coefficient of the metal greater than 0.1.

30. The process according to claim 29, wherein said catalyst has not more than 2% by weight of the noble metal present in particles with a diameter of less than 2 nm, whereas the number of particles of noble metal having a diameter higher than 4 nm is at least 70% with respect to the total.

31. The process according to claim 24, wherein said catalyst additionally comprises an inert inorganic additive in a quantity ranging from 30 to 70% by weight.

32. The process according to claim 31, wherein, in said catalyst, the metal was deposited on the carrier after the addition of said inert additive.

33. The process according to claim 1, wherein middle distillates are obtained with an overall yield of more than 70% with respect to the feeding mixture of(i).

34. The process according to claim 1, wherein at least one of a kerosene fraction or a gas oil-fraction is recovered from the separation according to (iv).

35. The process according to claim 34, wherein a portion of the said kerosene and/or gas oil fraction is recycled to the hydrocracking (iii) in order to undergo further hydrocracking/hydroisomerization.

36. The process according to claim 34, wherein a portion of less than 50%, by weight of said kerosene fraction, gas oil fraction, or both is merged with said mixture (C) to undergo further hydrocracking/hydroisomerization.

37. The process according to claim 19, wherein an alpha conversion level of the 370+° C. fraction of at least 80% is obtained.

38. The process according to claim 20, wherein said hydrocracking alpha conversion level in (iii) is from 80 to 90%.

39. The process according to claim 36, wherein the portion of said kerosene fraction, gas oil fraction or both is less than 30%.

40. The process according to claim 26, wherein the metal in the hydrocracking catalyst has a concentration of 0.2 to 0.8% by weight.

* * * * *